US012414596B2

(12) United States Patent
Palchevsky et al.

(10) Patent No.: US 12,414,596 B2
(45) Date of Patent: Sep. 16, 2025

(54) HOOD STRUCTURE FOR A GARMENT

(71) Applicant: LULULEMON ATHLETICA CANADA INC., Vancouver (CA)

(72) Inventors: Elena Palchevsky, Maple Ridge (CA); Kim Bernice Wormgoor, Squamish (CA)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 0 days.

(21) Appl. No.: 18/470,236

(22) Filed: Sep. 19, 2023

(65) Prior Publication Data

US 2024/0099409 A1 Mar. 28, 2024

Related U.S. Application Data

(60) Provisional application No. 63/408,945, filed on Sep. 22, 2022.

(51) Int. Cl.
*A42B 1/04* (2021.01)
*A42B 7/00* (2006.01)

(52) U.S. Cl.
CPC . *A42B 1/04* (2013.01); *A42B 7/00* (2013.01)

(58) Field of Classification Search
CPC ..... A41D 3/04; A41D 2200/20; A42B 1/04; A42B 1/048
See application file for complete search history.

(56) References Cited

U.S. PATENT DOCUMENTS 1,309,042 A * 7/1919 Milkes ..... A41D 3/04 2/84
4,422,184 A * 12/1983 Myers ..... A01K 55/00 2/84
5,546,604 A * 8/1996 Geller ..... A42B 1/046 2/202
5,794,263 A * 8/1998 Carman ..... A41D 13/001 2/202
5,909,802 A * 6/1999 Puco ..... A45F 3/04 224/148.1
6,370,692 B1 * 4/2002 Duyn ..... A41D 3/02 2/202
2014/0317829 A1 * 10/2014 Rolfe ..... A41D 3/00 2/202

* cited by examiner

*Primary Examiner* — Sally Haden

(57) ABSTRACT

Examples of a hood structure for a garment are disclosed. The hood structure includes a first hood portion for covering at least a portion of a wearer's head. The first hood portion has an outer surface, an inner surface, and an opening edge that defines a face opening when the hood structure is worn by the wearer. The hood structure also includes a second hood portion with an attachment edge that is attached to the outer surface of the first hood portion and an unattached edge. The second hood portion reversibly pivots around the attachment edge between a first position and a second position. In the first position, the second hood portion at least partially covers the first hood portion. In the second position, the second hood portion at least partially covers the face opening.

13 Claims, 4 Drawing Sheets

HOOD STRUCTURE FOR A GARMENT

FIELD OF INVENTION

This invention relates to hood structures for garments, and more particularly, to hood structures for garments that include first and second portions, the second portion for reversibly covering a face opening of the hood structure.

BACKGROUND OF THE INVENTION

Mosquitos and other insects are known for their ability to inflict bites and stings. In addition to this annoyance, many insects also transmit parasites, viruses and other diseases. Various chemicals, often in the form of sprays, and electrical devices have been developed to protect people from insect bites and stings, but with limited success and applicability to those enjoying outdoor environments. Many chemical repellants are often objectionable as the chemical typically has a foul odour and includes an oily base which can be irritating to the eyes and skin. Furthermore, numerous insect-repelling chemicals are known carcinogens. Lastly, chemical repellants lose effectiveness through wear or dilution by moisture and must be continuously reapplied.

Insect-excluding fabrics have also been utilized to prevent bites and stings. A well-known example being the use of an insect net hung over a bed, or a hat incorporating an insect-excluding fabric to protect the head, face and neck of the wearer. However, when used as a separate garment from other garments, such as a jacket or pullover, the wearer may forget this article of clothing when going out to engage in outdoor recreational activities. Furthermore, environmental conditions often change in the outdoors, and insect persistence may increase during the activity, leaving the wearer with unprotected skin. During outdoor activity and exercise, the wearer requires garments that have all functionality integrated within the garment, and that are quick to use and easy to adjust.

Thus, there exists a need for garments incorporating features which provide protection against insect bites and stings.

SUMMARY OF THE INVENTION

In various embodiments, the present disclosure provides a hood structure for garments with a portion that can be used to cover a face of a wearer in order to provide protection against insect bites and stings. This covering portion is integrated with the hood structure itself, and not as a separate article of clothing. The covering portion is quickly and easily moveable between positions, for ease of use during activity in outdoor environments.

In one aspect, the present disclosure provides a hood structure for a garment, comprising: a first hood portion for covering at least a portion of a wearer's head, the first hood portion comprising an outer surface, an inner surface, and an opening edge that defines a face opening when the hood structure is worn by the wearer; and a second hood portion comprising an attachment edge that is attached to the outer surface of the first hood portion and an unattached edge, wherein the second hood portion reversibly pivots around the attachment edge between a first position and a second position, wherein in the first position, the second hood portion at least partially covers the first hood portion, and in the second position, the second hood portion at least partially covers the face opening.

In various embodiments, the first hood portion further comprises a lower edge for attachment of the first hood portion to the garment.

In various embodiments, the attachment edge is proximate to or along a medial axis of the first hood portion.

In various embodiments, the second hood portion comprises a mesh-type fabric.

In various embodiments, the first hood portion, the second hood portion, or both the first and second hood portion comprise more than one fabric panel.

In various embodiments, the first hood portion comprises one or more layers between the outer surface and the inner surface.

In various embodiments, the second hood portion further comprises connecting means for connecting a cord to or adjacent to the unattached edge. For example, the connecting means may comprise one or more of grommets, lugs, hooks, an eyelet, loops, clasps, or a fabric channel comprising an opening. The cord may comprise polyester, braided polyester, paracord, braided nylon, a flexible LED, recycled nylon or recycled polyester. In various embodiments, the second hood portion may further comprise tensioning means for tensioning the cord. For example, the tensioning means may comprise one or more cord locks, one or more toggles, one or more buckles, one or more snap fasteners, one or more buttons, one or more hooks, one or more loops or a combination thereof.

In various embodiments, the attachment edge of the second hood portion is attached to the first hood portion by stitching, serging, an adhesive, a staple, a chemical bond, a heated bond, a zipper, one or more buttons, one or more snap fasteners, one or more hook and loop fasteners, one or more buckles or a combination thereof.

In various embodiments, the opening edge of the first hood portion further comprises supporting means for providing structural support to the opening edge. For example, the supporting means may comprise structural seaming, one or more additional fabric layers, a cord, a wire, a flexible metal insert, a molded fabric construction or a combination thereof.

In various embodiments, the garment is a shirt, a sweater, a jacket, a poncho, a dress or a jumpsuit.

In various embodiments, the first hood portion further comprises attachment means for attaching the first hood portion to the garment. For example, the attachment means may comprise stitching, serging, an adhesive, a staple, a chemical bond, a heated bond, a zipper, one or more buttons, one or more snap fasteners, one or more hook and loop fasteners, one or more buckles or a combination thereof.

In addition to the aspects and embodiments described above, further aspects and embodiments will become apparent by reference to the drawings.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the disclosure. Sizes and relative positions of elements in the drawings are not necessarily drawn to scale. For example, the shapes of various elements and angles are not drawn to scale, and some of these elements are arbitrarily enlarged and positioned to improve drawing legibility.

In the accompanying drawings, which illustrate one or more exemplary embodiments.

DETAILED DESCRIPTION

Reference will now be made in detail to embodiments of the invention, examples of which are illustrated in the accompanying drawings. While the invention is described in conjunction with these embodiments, it will be understood that the descriptions herein are not intended to limit the invention to these embodiments. On the contrary, the invention is intended to cover alternatives, modifications, and equivalents that may be included within the scope of the invention as defined by the appended claims. Detailed description of components that are well known in the art may be omitted if that detailed description would confuse or obscure the description of the embodiments of the present invention.

In the context of the present disclosure, various terms are used in accordance with what is understood to be the ordinary meaning of those terms.

Directional terms such as "top", "bottom", "front", "back", "upper", "lower", "outer" and "inner" are used in the following description for the purpose of providing relative reference only, and are not intended to suggest any limitations on how any article or garment is to be positioned during use, or relative to an environment. The use of the word "a" or "an" when used herein in conjunction with the term "comprising" may mean "one", but it is also consistent with the meaning of "one or more", "at least one", and "one or more than one". Any element expressed in the singular form also encompasses its plural form. Any element expressed in the plural form also encompasses its singular form. The term "plurality" as used herein means more than one, for example, two or more, three or more, for or more, and the like.

The present disclosure provides a hood structure for a garment. In various embodiments, the disclosure provides hood structures that include a portion that is moveable between positions such that a portion of the hood structure can be used to cover a wearer's face as desired. The hood structures as provided herein are particularly useful during activity, as the wearer can easily and quickly move the portion of the hood structure to at least partially or completely cover the wearer's face to, for example, prevent insect stings and bites.

A common nuisance of outdoor activity is insect, particularly mosquito, bites and stings. Embodiments of the present disclosure provide protection to the wearer's face from such bites and stings, without impeding activity.

Figure 1:
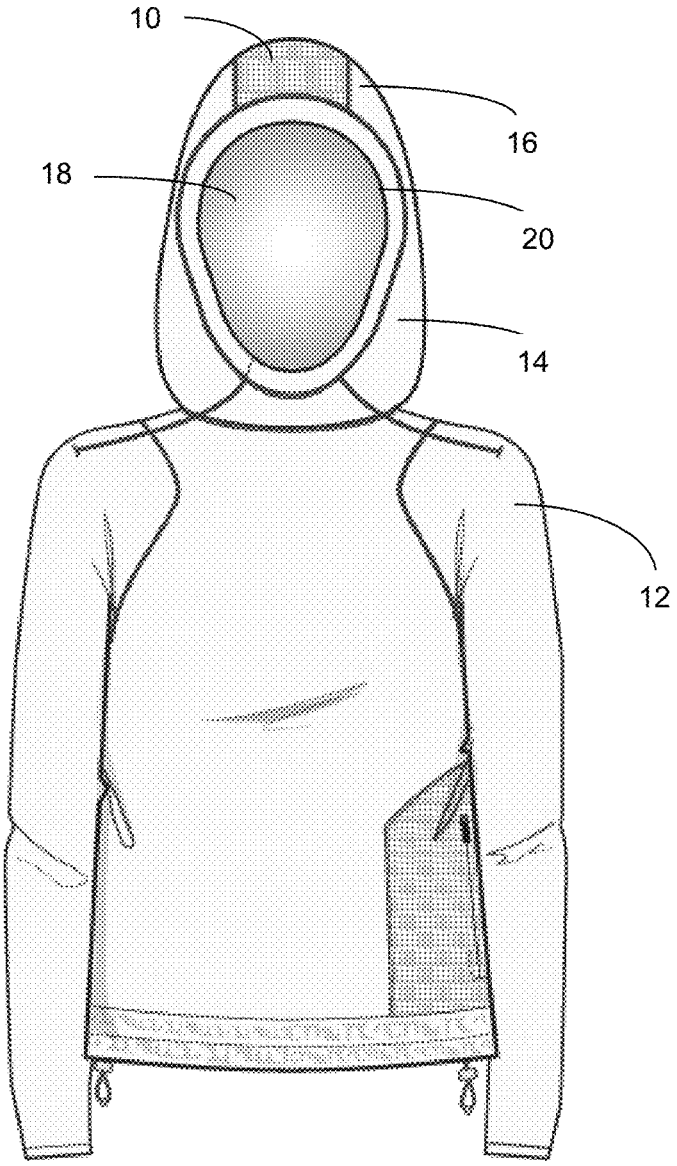
FIG. 1 is a front plan view of a garment with a hood structure according to an embodiment of the invention.
Figure 2:
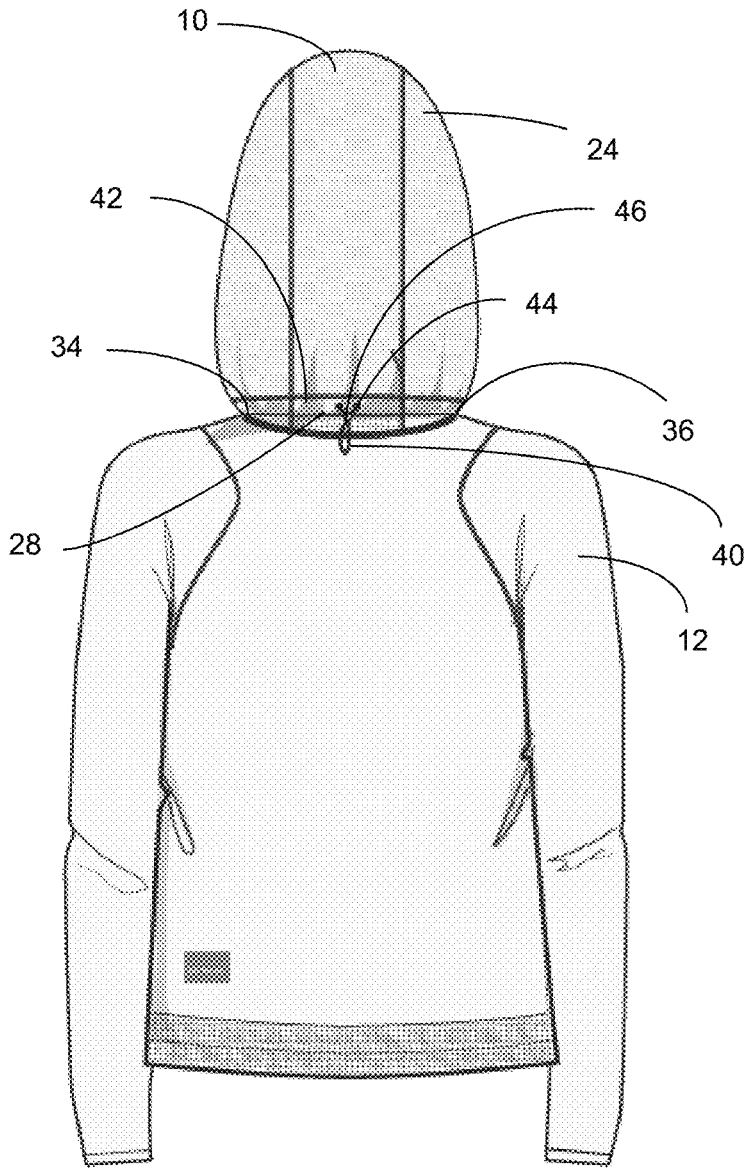
FIG. 2 is a back plan view of a garment with a hood structure according to an embodiment of the invention.
Figure 3:
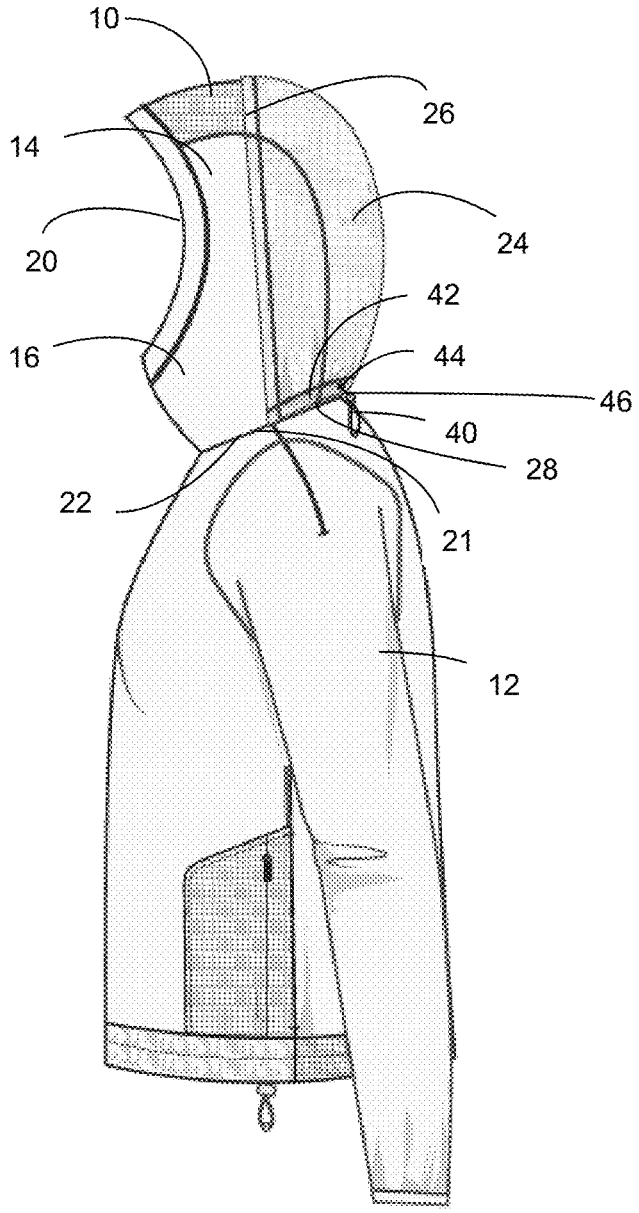
FIG. 3 is a side plan view of a garment with a hood structure according to an embodiment of the invention.

Referring to FIGS. 1 to 3, and according to a first embodiment of the disclosure, a hood structure 10 for a garment 12 is shown. The hood structure 10 includes a first hood portion 14 for covering at least a portion of a wearer's head. The first hood portion 14, when attached to the garment 12, is moveable between a lower position, when it is not covering the wearer's head, to an upper position where the first hood portion 14 covers at least a portion of the wearer's head. In various embodiments, the first hood portion may cover the back of the wearer's head, including the ears, and leave a face of the wearer uncovered. In various embodiments, the first hood portion 14 may extend to a forehead of the wearer. The first hood portion 14 may also extend outwards from the forehead of the wearer, thereby creating a sun or rain shield. The first hood portion 14 comprises an outer surface 16, an inner surface 18 and an opening edge 20 that defines a face opening. In various embodiments, the first hood portion 14 may be made of a solid fabric panel. In various embodiments, the first hood portion 14 may comprise one or more than one fabric panel. The first hood portion 14 may also comprise one or more layers between the outer surface 16 and the inner surface 18. In various embodiments, the first hood portion 14 may be constructed from an extended panel portion of the garment 12, such as a back panel.

In various embodiments, and as shown in FIG. 3, the first hood portion 14 has a lower edge 22 for attachment of the first hood portion to the garment 12. The first hood portion 14 may also comprise attachment means 21 for attaching the first hood portion 14 to the garment 12. The attachment means 21 may comprise stitching, serging, an adhesive, a staple, a chemical bond, a heated bond, a zipper, one or more buttons, one or more snap fasteners, one or more hook and loop fasteners, one or more buckles or a combination thereof. In the Figures, the lower edge 22 of the first hood portion 14 is attached to the garment 12 by stitching as the attachment means 21.

The opening edge 20 of the first hood portion 14 may comprise supporting means for providing structure support to the opening edge 20, so that the opening edge 20 has more structural support and rigidity to define the face opening for the wearer. The supporting means may comprise structural seaming, one or more additional fabric layers, a cord, a wire, a flexible metal insert, a molded fabric construction or a combination thereof.

Figure 4:
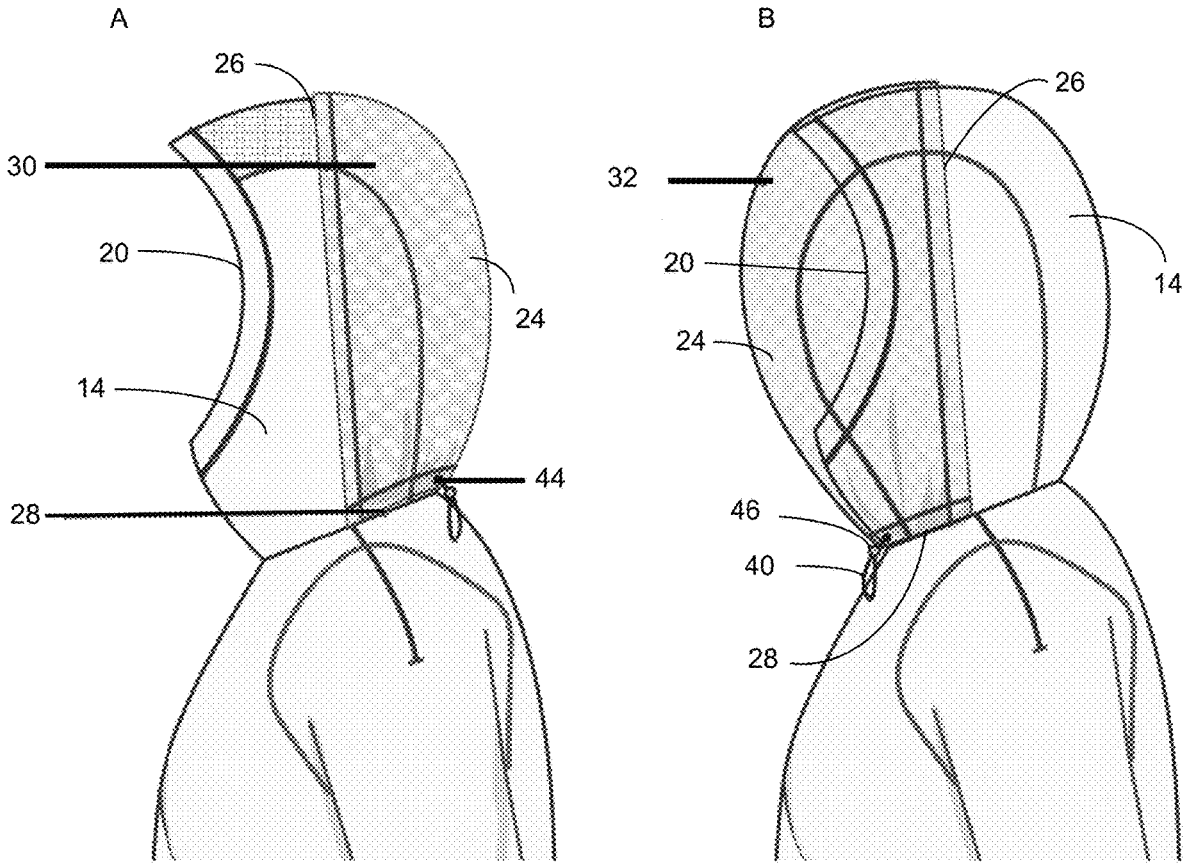
FIG. 4 is a side plan view of a garment with a hood structure according to an embodiment of the invention, with a second hood portion in a first position at least partially covering a first hood portion (FIG. 4A) and the second hood portion in a second position at least partially covering a face opening of the hood structure (FIG. 4B).

The hood structure 10 also comprises a second hood portion 24. The second hood portion 24 comprises an attachment edge 26 that is attached to the outer surface 16 of the first hood portion 14 and an unattached edge 28. The second hood portion 24 reversibly pivots around the attachment edge 26 between a first position 30 and a second position 32. In the first position 30 (FIG. 4A), the second hood portion 24 at least partially covers the first hood portion 14. In this position, when the first hood portion 14 is at least partially covering the wearer's head, the face of the wearer is uncovered. The wearer may then pull on the second hood portion 24, moving the second hood portion 24 into the second position 32 (FIG. 4B) through a reversible pivot around the attachment edge 26. The unattached edge 28 of the second hood portion 24 allows this movement to occur. In the second position 32, the second hood portion 24 at least partially covers the face opening as defined by the opening edge 20. In various embodiments, the second hood portion 24 covers the entire face opening as defined by the opening edge 20.

The attachment edge 26 may be positioned proximate to or along a medial side-to-side axis of the first hood portion 14, the side-to-side axis referred to from a front view or a rear view of the hood structure, as shown in FIGS. 1 and 2. In various embodiments, the attachment edge 26 may extend along the entire side-to-side axis, from a first attachment position 34 on the lower edge 22 of the first hood portion 14 to a second attachment position 36 on the lower edge 22 on an opposing side of the first hood portion 14. In various embodiments, the attachment edge 26 may be offset from the medial side-to-side axis, such that it is closer to the opening edge 20 and the attachment edge 26 is between the medial side-to-side axis and the opening edge 20. Alternatively, the attachment edge 26 may be offset from the medial side-to-side axis, such that it is closer to a back portion of the first hood portion 14 and the attachment edge 26 is between the medial side-to-side axis and the back portion.

In various embodiments, the attachment edge 26 of the second hood portion 24 may be attached to the first hood portion 14 by stitching, serging, an adhesive, a staple, a chemical bond, a heated bond, a zipper, one or more buttons, one or more snap fasteners, one or more hook and loop fasteners, one or more buckles or a combination thereof. For example, and in the Figures, the attachment edge 26 of the second hood portion 24 is attached to the first hood portion 14 by stitching.

In various embodiments, the second hood portion 24 comprises a mesh-type fabric, thereby allowing the wearer to be able to see and the hood structure to have sufficient breathability during outdoor recreation, while providing protection against insects biting or stinging the face of the wearer. The holes of the mesh-type fabric are sufficiently small such that insects cannot pass through them. The second hood portion 24 may be positioned away from the skin of the face, such that insects cannot reach the skin to sting or bite. Positioning the second hood portion 24 may be aided by the shape of the first hood portion 14 (for example, by the first hood portion extending away from the forehead or the opening edge 20 comprising the supporting means or a portion of the first hood portion 14 extending around a neck of the wearer), or by wearing a hat under the hood structure 10. The mesh-type fabric may be of any suitable aesthetic or functional colour, for example, the colour may be one that is least distracting to the wearer to look through. In various embodiments, the second hood portion 24 may comprise one or more than one fabric panel.

The second hood portion 24 may further comprise a cord 40 at or adjacent to the unattached edge 28 of the second hood portion 24. The second hood portion 24 may also have a connecting means 42 for connecting the cord 40 to or adjacent to the unattached edge 28. The cord 40 may be for positioning and holding the second hood portion 24 in the first position 30 and in the second position 32. When in the second position 32, the cord 40 may also prevent insects from getting into the hood structure 10 by holding the second hood portion 24 against the skin of the wearer or against the portion of the first hood portion 14 that may extend around a neck of the wearer.

The connecting means 42 may comprise one or more of grommets, lugs, hooks, an eyelet, loops, clasps or a fabric channel comprising an opening. In the Figures, the connecting means 42 is the fabric channel comprising the opening 44 through which the cord 40 is located. In various embodiments, the cord 40 may comprise polyester, braided polyester, paracord, braided nylon, a flexible LED, recycled nylon or recycled polyester. The second hood portion 24 may also comprising tensioning means 46 for tensioning the cord 40. The tensioning means 46 may comprise one or more cord locks, one or more toggles, one or more buckles, one or more snap fasteners, one or more buttons, one or more hooks, one or more loops or a combination thereof.

In various embodiments, the garment 12 may be packable within the hood structure 10. For example, the first hood portion 14 and the second hood portion 24 may define a receptacle into which the garment may be stored. In various embodiments, the cord of the second hood portion 24 may be used to secure the receptacle with the remainder of the garment 12 inside. In various embodiments, second hood portion 24 may be constructed of a material that provides additional properties such as ultraviolet (UV) protection, particle and/or pollution filtering, wind protection, temperature modification or a combination thereof, either in conjunction with or in substitution for protection from insects.

While particular elements, embodiments and applications of the present application have been shown and described, it will be understood, that the scope of the application is not limited thereto, since modifications can be made by those skilled in the art without departing from the scope of the present application, particularly in light of the foregoing teachings. Thus, for example, in any method or process disclosed herein, the acts or operations making up the method/process may be performed in any suitable sequence and are not necessarily limited to any particular disclosed sequence. Elements and components can be configured or arranged differently, combined, and/or eliminated in various embodiments. The various features and processes described above may be used independently of one another, or may be combined in various ways. All possible combinations and subcombinations are intended to fall within the scope of this application. Reference throughout this disclosure to "some embodiments," "an embodiment," or the like, means that a particular feature, structure, step, process, or characteristic described in connection with the embodiment is included in at least one embodiment. Thus, appearances of the phrases "in some embodiments," "in an embodiment," or the like, throughout this disclosure are not necessarily all referring to the same embodiment and may refer to one or more of the same or different embodiments. Indeed, the novel methods and systems described herein may be embodied in a variety of other forms; furthermore, various omissions, additions, substitutions, equivalents, rearrangements, and changes in the form of the embodiments described herein may be made without departing from the spirit of the application.

Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without operator input or prompting, whether these features, elements and/or steps are included or are to be performed in any particular embodiment. No single feature or group of features is required for or indispensable to any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The example calculations, simulations, results, graphs, values, and parameters of the embodiments described herein are intended to illustrate and not to limit the disclosed embodiments. Other embodiments can be configured and/or operated differently than the illustrative examples described herein.

What is claimed is:

1. A hood structure for a garment, comprising:

a first hood portion for covering at least a portion of a wearer's head, the first hood portion comprising a lower edge for attachment of the first hood portion to the garment, an outer surface, an inner surface, and an opening edge that defines a face opening when the hood structure is worn by the wearer; and a second hood portion comprising an attachment edge to attach the second hood portion to the outer surface of the first hood portion and an unattached edge, wherein the attachment edge extends along an entire medial side-to-side axis from a first attachment point on the lower edge of the first hood portion to a second attachment point on an opposing side of the lower edge of the first hood portion, wherein the second hood portion reversibly pivots around the attachment edge between a first position and a second position, and wherein in the first position, the second hood portion covers a back part of the first hood portion extending backwards from the medial side-to-side axis such that the unattached edge of the second hood portion is in proximity to a back side of the lower edge of the first hood portion, and in the second position, the second hood portion covers the entire face opening extending forwards from the medial side-to-side axis such that the unattached edge of the second hood portion is positioned under and away from the face opening and in proximity to a front portion of the garment.

2. The hood structure of claim 1, wherein the second hood portion comprises a mesh-type fabric.

3. The hood structure of claim 1, wherein the first hood portion, the second hood portion, or both the first and second hood portions comprise more than one fabric panel.

4. The hood structure of claim 1, wherein the first hood portion comprises one or more layers between the outer surface and the inner surface.

5. The hood structure of claim 1, wherein the second hood portion further comprises a cord and connecting means for connecting the cord to or adjacent to the unattached edge for positioning and holding the second hood portion in the first position over the back part of the first hood portion and in the second position over the face opening.

6. The hood structure of claim 5, wherein the connecting means comprise a fabric closed ended channel comprising an opening positioned between the closed ends of the channel, the cord inserted and secured in the channel, and a part of the cord pulled out and extending outwards from the opening.

7. The hood structure of claim 6, wherein the second hood portion further comprises tensioning means for tensioning the cord.

8. The hood structure of claim 7, wherein the tensioning means are coupled to the part of the cord that extends out of the opening, the tensioning means comprising one or more cord locks, one or more toggles, one or more buckles, one or more snap fasteners, one or more buttons, one or more hooks, one or more loops or a combination thereof.

9. The hood structure of claim 5, wherein the cord comprises polyester, braided polyester, paracord, braided nylon, a flexible LED, recycled nylon or recycled polyester.

10. The hood structure of claim 1, wherein the attachment edge of the second hood portion is attached to the first hood portion by stitching.

11. The hood structure of claim 1, wherein the garment is a shirt, a sweater, or a jacket.

12. The hood structure of claim 1, wherein the first hood portion further comprises attachment means for attaching the first hood portion to the garment.

13. The hood structure of claim 12, wherein the attachment means comprise stitching.

* * * * *